US006772609B2

(12) United States Patent
Darcangelo et al.

(10) Patent No.: US 6,772,609 B2
(45) Date of Patent: Aug. 10, 2004

(54) MULTI-LENS FINISHING PROCESS

(75) Inventors: Charles M. Darcangelo, Corning, NY (US); Larry G. Mann, Painted Post, NY (US); Albert R. Nieber, Corning, NY (US); Jose M. Quintal, Campbell, NY (US)

(73) Assignee: Corning Incorporated, Corning, NY (US)

( * ) Notice: Subject to any disclaimer, the term of this patent is extended or adjusted under 35 U.S.C. 154(b) by 149 days.

(21) Appl. No.: 10/016,839

(22) Filed: Dec. 13, 2001

(65) Prior Publication Data

US 2003/0205058 A1 Nov. 6, 2003

(51) Int. Cl.[7] ..... C03C 19/00

(52) U.S. Cl. ..... 65/61; 65/62; 65/112; 451/42

(58) Field of Search ..... 65/23, 37, 112, 65/21.5, 409, 62; 264/158; 83/29; 451/42

(56) References Cited

U.S. PATENT DOCUMENTS 450,507 A 4/1891 Dalot
2,436,819 A 3/1948 Neidorf et al.
2,964,443 A * 12/1960 Dereich ..... 156/298
3,218,764 A 11/1965 Deeren et al.
3,247,589 A 4/1966 Burns et al.
4,084,308 A * 4/1978 Runge ..... 29/527.2
4,760,672 A * 8/1988 Darcangelo et al. ..... 451/42
5,218,654 A 6/1993 Sauter
5,528,724 A * 6/1996 Chang et al. ..... 385/137
5,630,857 A * 5/1997 Xu et al. ..... 65/17.3
5,652,814 A 7/1997 Pan et al.
5,917,105 A * 6/1999 Xu et al. ..... 65/37
6,135,867 A 10/2000 Yeagle et al.

* cited by examiner

*Primary Examiner*—Steven P. Griffin
*Assistant Examiner*—Carlos Lopez
(74) *Attorney, Agent, or Firm*—Timothy M. Schaeberle

(57) ABSTRACT

A method for producing lenses includes assembling a plurality of glass rods having a desired length into a single unit and cutting the single unit into multiple slices, each slice having a plurality of individual lenses. The method further includes finishing the slices to a desired thickness and surface finish and extracting the individual lenses from the slices.

16 Claims, 8 Drawing Sheets

MULTI-LENS FINISHING PROCESS

BACKGROUND OF INVENTION

1. Field of the Invention

The invention relates to a method for finishing lenses, particularly very small lenses such as gradient index lenses.

2. Background Art

A gradient index (GRIN) lens has a refractive index that changes continuously. GRIN lenses have many uses in optical devices such as switches, isolators, couplers, wavelength division multiplexers, and circulators. GRIN lenses are made from glass rods with gradient refractive indexes. Methods for making such glass rods are well known in the art. Typically, the gradient refractive index is achieved by introducing dopants into different layers of the glass material.

The process for fabricating a GRIN lens involves cutting a desired length of a glass rod having a gradient refractive index and finishing the glass rod into a lens that has the desired dimensional and optical characteristics. The finishing process generally involves several steps. A typical sequence of steps for finishing a lens is as follows: grind the faces of the lens, lap the faces of the lens, polish the faces of the lens, clean the lens, coat the lens with an anti-reflective material, clean the lens, inspect the lens, and package the lens.

GRIN lenses are very small lenses. For example, a GRIN lens may be 1.8 mm in diameter by 4.82 mm in length, or smaller. Currently, GRIN lenses are processed one at a time through many or all of the finishing process steps described above, which is a very expensive way of finishing such small lenses. Moreover, handling glass through many or all of the finishing process steps can result in damage to the lens.

SUMMARY OF INVENTION

In one aspect, the invention relates to a method for producing lenses which comprises assembling a plurality of glass rods having a desired length into a single unit, cutting the single unit into multiple slices, each slice having a plurality of individual lenses, finishing the slices to a desired thickness and surface finish, and extracting the individual lenses from the slices.

In another aspect, the invention relates to a method for producing gradient index lenses which comprises assembling a plurality of glass rods having a gradient refractive index into a single unit, cutting the single unit into multiple slices, each slice having a plurality of individual lenses, finishing the slices, and extracting the individual lenses from the slices.

In another aspect, the invention relates to a method for producing lenses which comprises assembling a plurality of glass rods having a desired length into a single unit, cutting the single unit into multiple slices, each slice having a plurality of individual lenses, finishing the slices to a desired thickness and surface finish, coating the slices with an anti-reflective material, cleaning the slices, and extracting the individual lenses from the slices.

Other features and advantages of the invention will be apparent from the following description and the appended claims.

DETAILED DESCRIPTION

A method for fabricating lenses consistent with the principles of the invention minimizes individual lens handling by assembling multiple lenses into a single unit that can be finished in the same manner that a single lens can be finished. As an example, a single unit can group 2 to 20,000 lenses at once. The single units are easier to handle and orient than individual lenses, allowing significant reduction in the cost of finishing the lenses. Specific embodiments of the invention are described below with reference to the accompanying drawings.

Figure 1:
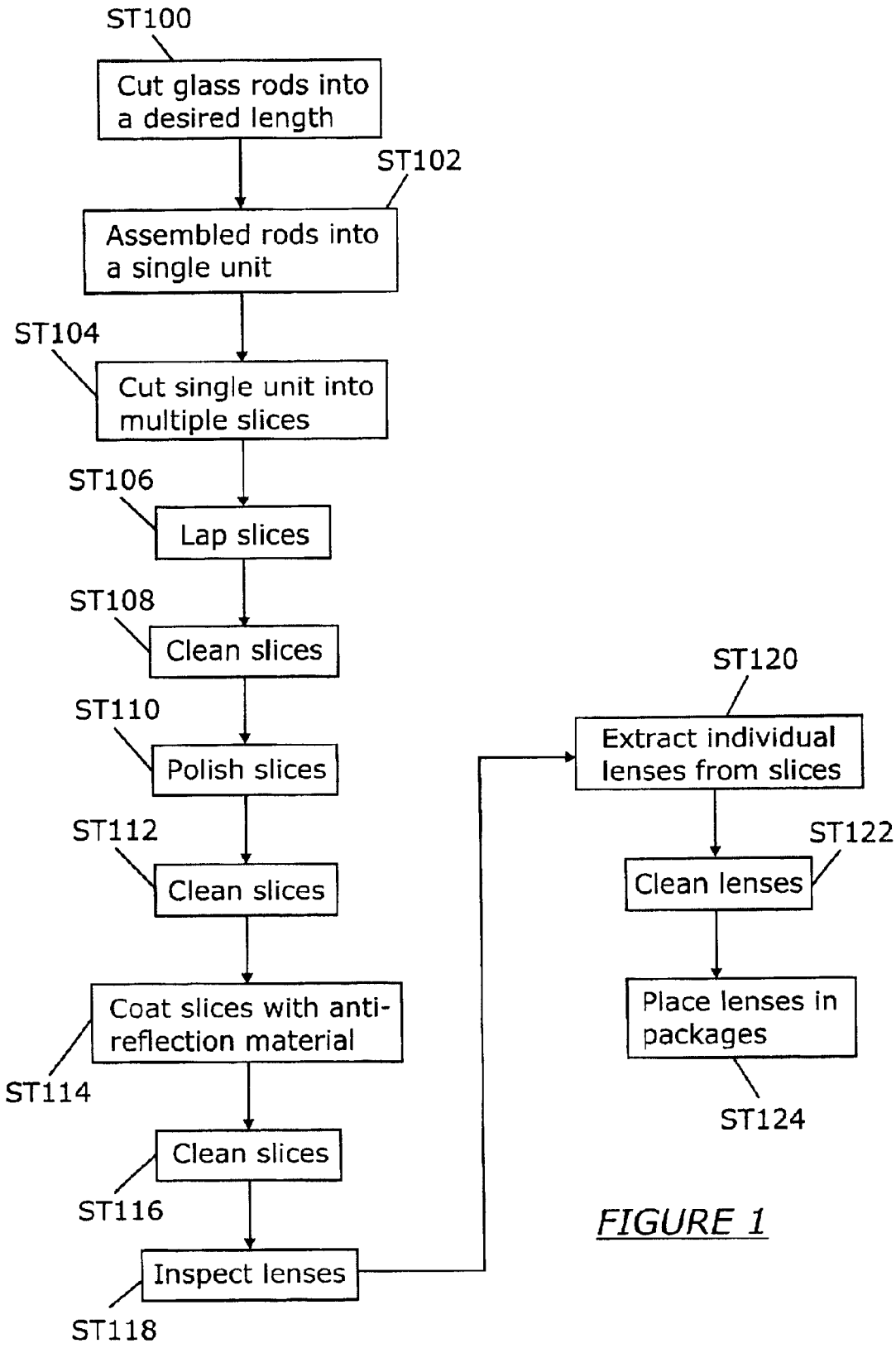
FIG. 1 is a flowchart illustrating a process for finishing lenses according to an embodiment of the invention.

FIG. 1 is a flowchart illustrating a process for fabricating lenses according to an embodiment of the invention. The process starts with cutting one or more glass rods into a desired length (ST100). For GRIN lenses, the glass rods have a gradient refractive index. The glass rods are then assembled into a single unit (ST102). The next step is to cut the single unit of glass rods into multiple slices (ST104). Each slice contains multiple lenses secured together as a single unit. Each slice can be finished in the same manner that a single lens would be finished. The finishing process starts with lapping of each slice to the desired thickness (ST106). Lapping involves grinding the faces of each slice with a loose abrasive. The surface finish obtained by the lapping process is somewhat rough, typically on the order of 125 to 625 nm Ra. Lapping may be single-sided or double-sided. In single-sided lapping, the faces of each slice are lapped one at a time. In double-sided lapping, the faces of each slice are lapped simultaneously.

After lapping, the wafers are placed in a cleaning system to remove loose material (ST108). The slices are then polished to the desired surface finish and thickness (ST110). Polishing is also a loose abrasive process. The surface finish is generally better than with the lapping process, typically in a range from 0.1 to 1 nm Ra. The polishing process may be single-sided or double-sided. In single-sided polishing, the faces of each slice are polished one at a time. In double-sided polishing, the faces of each slice are polished simultaneously. After polishing, the slices are again placed in a cleaning system to remove any loose material (ST112). The cleaned slices are then coated with an anti-reflective material (ST114). After the coating process, the slices are placed in a cleaning system (ST116). The cleaned slices are placed in inspection systems to measure dimensional and optical characteristics of the lenses (ST118). After inspection, the individual lenses are extracted from the slices (ST120). The individual lenses are placed into a cleaning system to remove all foreign materials from the lenses (ST122). Then the lenses are placed in individual packages (ST124).

Figure 2A:
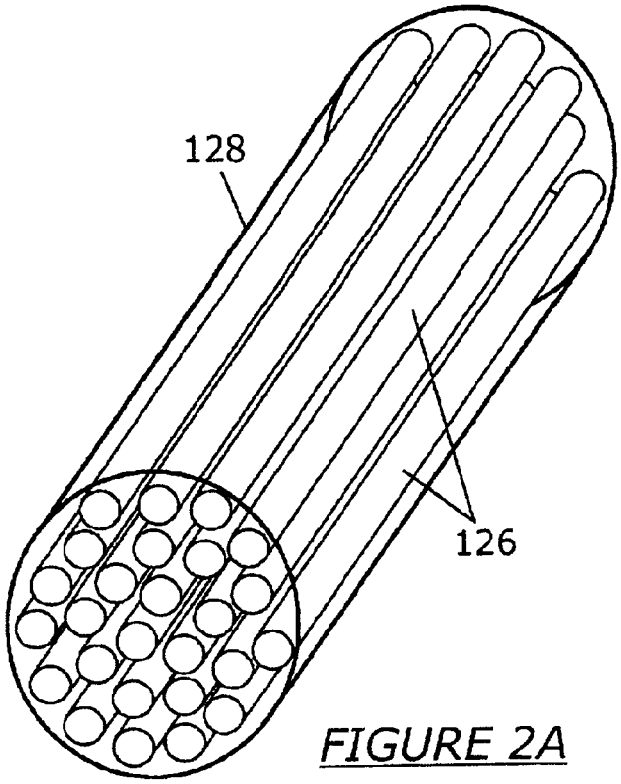
FIG. 2A shows glass rods inserted into a glass tube to form a single unit.
Figure 2B:
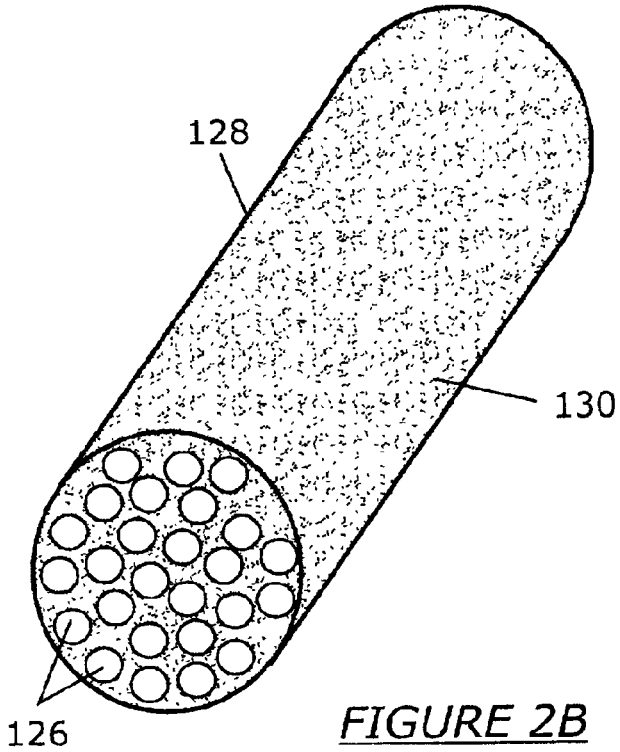
FIG. 2B shows the glass tube of FIG. 2A filled with a releasing medium.

Returning to step ST102, there are a variety of methods for assembling the glass rods into a single unit. FIG. 2A shows one method whereby glass rods 126 are inserted into a glass tube (or housing) 128. FIG. 2B shows the glass tube 128 filled with an appropriate blocking or releasing medium 130, such as epoxy, bees wax, or urethane blocking material. The blocking or releasing medium 130 holds the glass rods 126 together inside the glass tube 128 so that the glass rods and the glass tube 128 form a single unit. The glass tube 128 can be cut into multiple slices, as discussed above, using a wiresaw machine (not shown) or other suitable cutting apparatus. Wiresaw is a type of lapping process and can cut the glass tube 128 and glass rods 126 efficiently without damage to the glass.

Figure 3A:
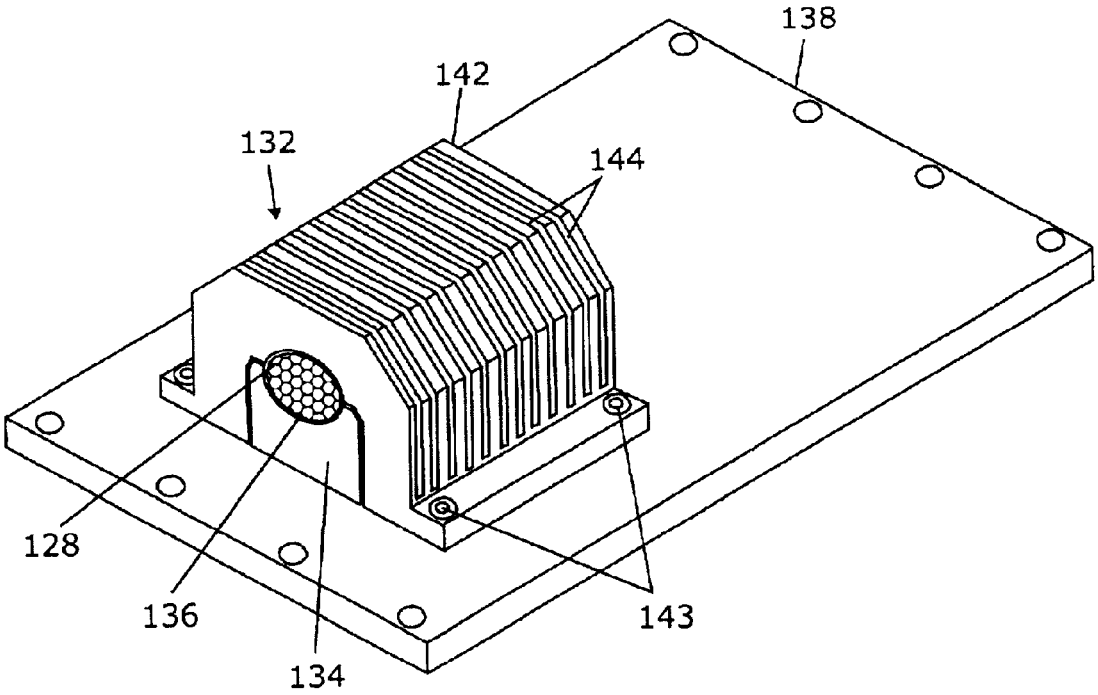
FIG. 3A shows the glass tube of FIG. 2B mounted in a slicing fixture.
Figure 3B:
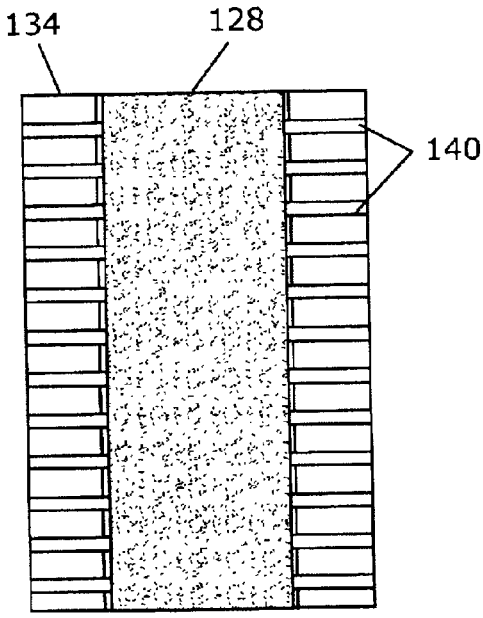
FIG. 3B shows a top view of the tube carrier shown in FIG. 3A.

FIG. 3A shows a slicing fixture 132 suitable for use with a wiresaw apparatus (not shown). The slicing fixture 132 includes a tube carrier 134 having a cavity 136 for receiving the glass tube 128. The tube carrier 134 is mounted on a plate 138. The plate 138 can be mounted on a wiresaw table (not shown). The tube carrier 134 may be secured to the plate 138 by any suitable means so that it is stationary relative to the plate 138 during the cutting action. FIG. 3B shows a top view of the tube carrier 134. As shown, the carrier 134 has multiple grooves 140 for receiving a cutting wire (not shown). The grooves 140 demarcate the positions where the glass tube 128 will be sliced. Returning to FIG. 3A, the slicing fixture 132 also includes a clamping plate 142 mounted on the tube carrier 134. The clamping plate 142, when secured to the plate 138 by bolts 143 or other suitable fasteners, clamps the glass tube 128 to the carrier 134. In this way, the glass tube 128 does not move during the cutting action.

Figure 3C:
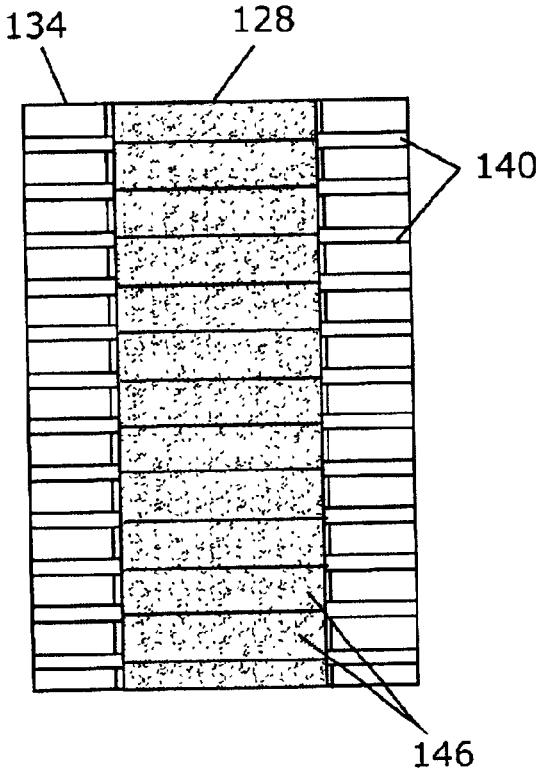
FIG. 3C shows the glass tube of FIG. 3B cut into multiple slices.
Figure 3D:
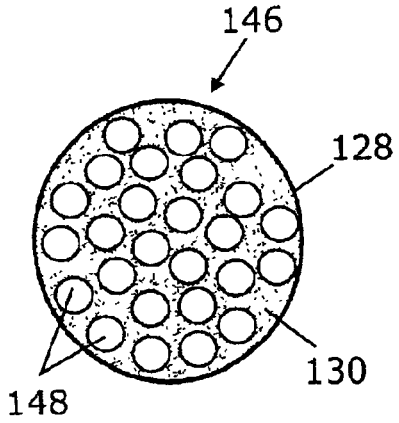
FIG. 3D is a front view of one of the slices in FIG. 3C.

The clamping plate 142 has multiple grooves 144 which are aligned with the grooves 140 (shown in FIG. 3B) in the tube carrier 134. In operation, the slicing fixture 132, with the glass tube 128 clamped between the clamping plate 142 and the tube carrier 134, is mounted on the wiresaw table (not shown). The wiresaw machine (not shown) is then operated such that the cutting wire (not shown) passes through the grooves 144 in the clamping plate 142 into the grooves (140 in FIG. 3B) in the tube carrier 134. As the cutting wire (not shown) passes into the grooves (140 in FIG. 3B), it cuts the glass tube 128 and the glass rods 126 inside the glass tube 128. FIG. 3C shows the glass tube 128 cut into multiple slices 146. Typically, the cutting process involves the use of an abrasive slurry, such as SiC in glycol, to provide a smooth cut. FIG. 3D shows one of the slices 146 with the multiple lenses 148 (i.e., segments of the glass rods 126 in FIG. 2A) held together by the releasing medium 130 and a segment of the glass tube 128. The slice 146 can be finished just as an individual lens would be finished, resulting in substantial savings in the time required to finish the lenses as well as reduction in damage to the glass.

Figure 4:
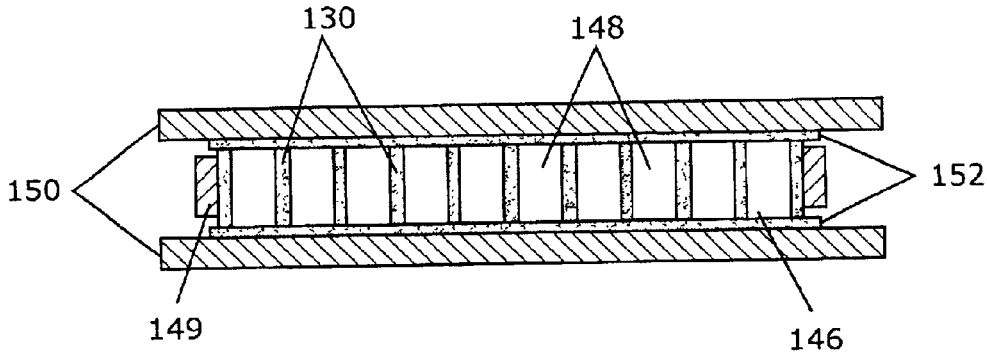
FIG. 4 shows a double-sided lapping process.

FIG. 4 shows a double-sided lapping process for the slice 146. The slice 146 is mounted in a lapping carrier 149, which is mounted between two lapping plates 150. Abrasive layers 152 are formed on the lapping plates 150. Typically, the abrasive layers 152 include a loose abrasive, such as aluminum oxide. Relative motion between the lapping plates 150 and the slice 146 laps or grinds the slice 146 to the desired thickness. The polishing setup is similar to the lapping setup. Typically, the polishing media is cerium oxide. After lapping and polishing, the slice 146 is coated with an antireflective material. Then, the individual lenses 148 are extracted from the slice 146. The process for extracting the individual lenses 148 involves placing the slice 146 in a solvent solution to dissolve the releasing medium 130.

Figure 5A:
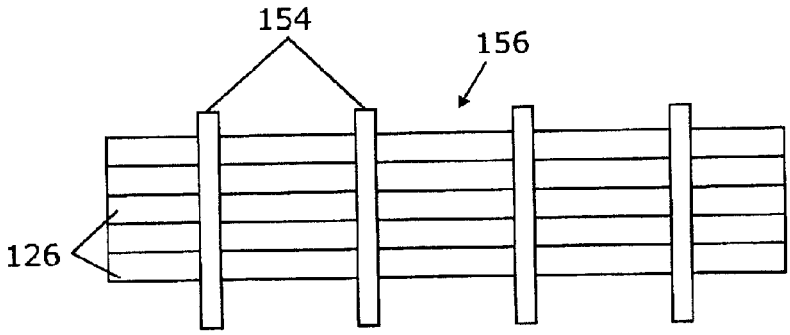
FIG. 5A shows glass rods inserted into a row of space rings to form a single unit.
Figure 5B:
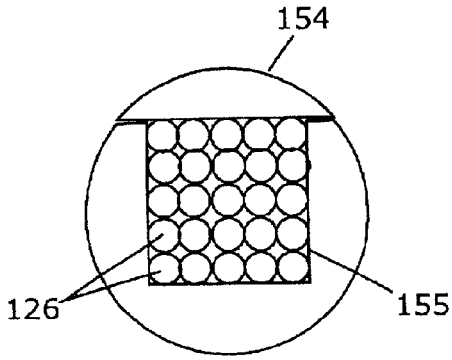
FIG. 5B is an end view of the assembly shown in FIG. 5A.
Figure 5C:
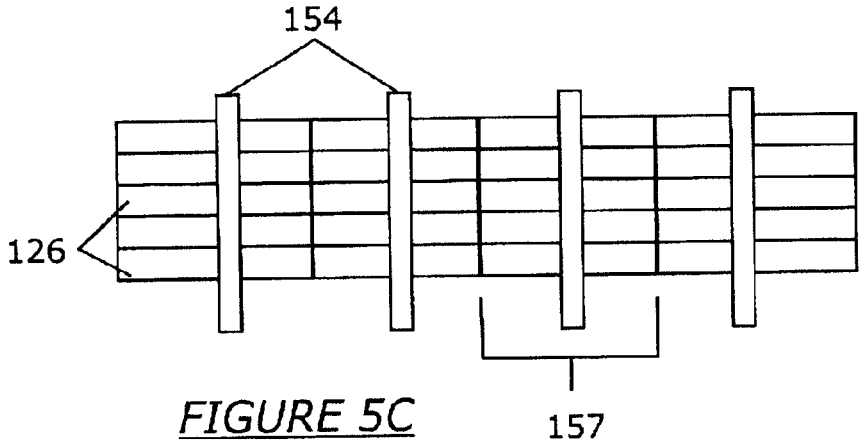
FIG. 5C shows the unit of FIG. 5A cut into multiple slices.

FIG. 5A shows another method for assembling glass rods into a single unit. As shown, the glass rods 126 are inserted into multiple split rings 154, which are aligned and spaced out in a row. As shown in FIG. 5B, the glass rods 126 are inserted through apertures 155 in the split rings 154. The apertures may have for various shapes, such as square, circular, hexagonal, etc. Returning to FIG. 5A, the split rings 154 are tightened around the glass rods 126 to form a tight assembly 156. The assembly 156 can be cut into multiple slices using a wiresaw apparatus (not shown) or other suitable cutting device. The assembly 156 would be cut in between the split rings 154, as shown in FIG. 5C. The slices 157 can be lapped, polished, coated with antireflective material, and cleaned as described above. The process for extracting the individual lenses from the slices is as simple as loosening the split rings 154.

Figure 6A:
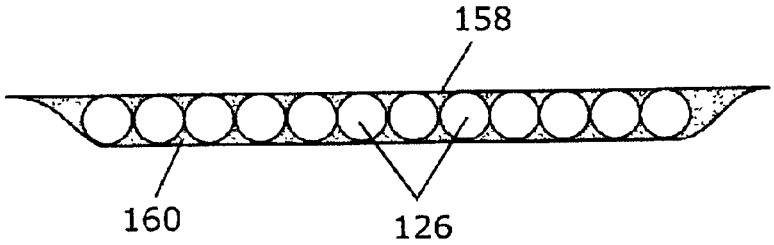
FIG. 6A shows glass rods arranged in a row in between a mat.
Figure 6B:
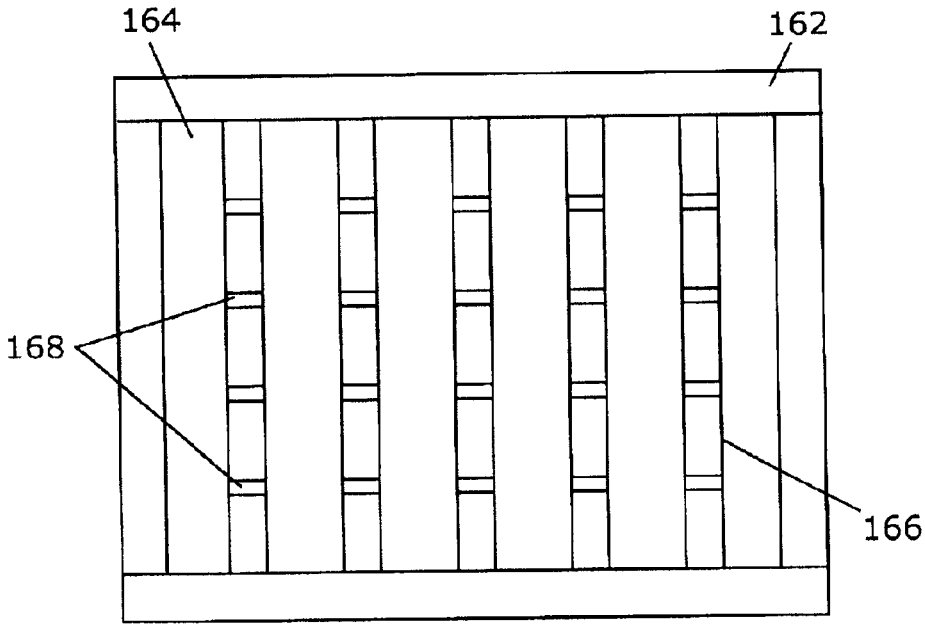
FIG. 6B shows a slicing fixture for the mat of glass rods shown in FIG. 6A.
Figure 6C:
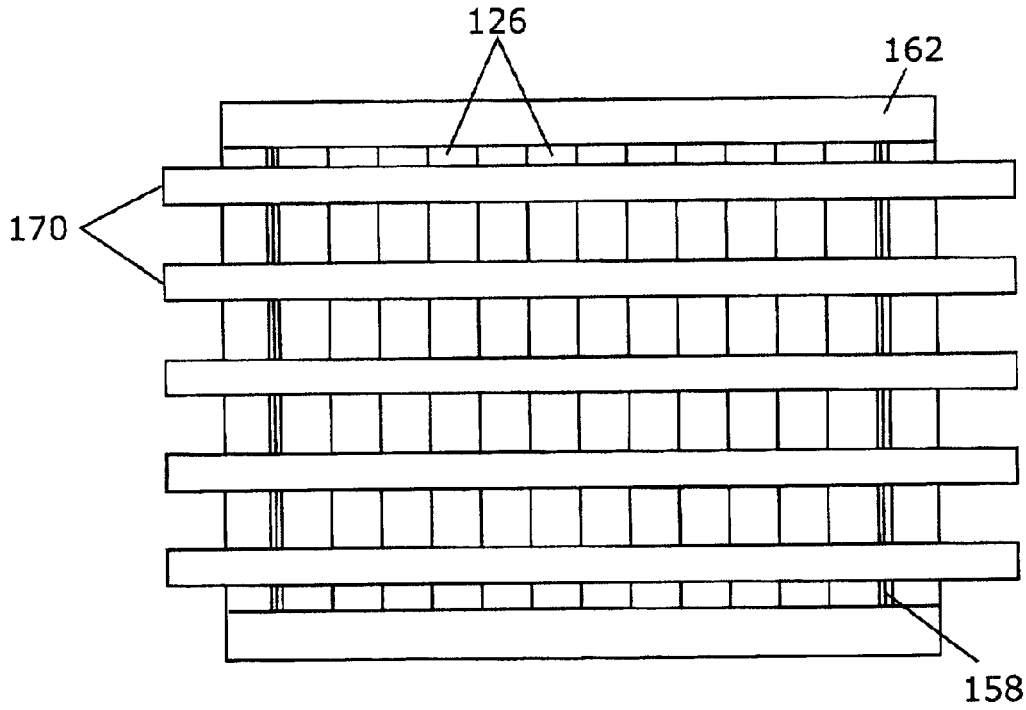
FIG. 6C shows the mat of glass rods clamped in the slicing fixture of FIG. 6B.

FIG. 6A shows another method for assembling glass rods into a single unit. As shown, the glass rods 126 are arranged in a single row in between a mat 158. The mat 158 may be made of two thin plastic film sheets or two glass sheets or a plastic film and a glass sheet. The glass rods 126 may be held in place in between the mat 158 by an appropriate blocking or releasing medium 160, such as epoxy or bees wax or urethane blocking material. FIG. 6B shows a slicing fixture 162 for the mat (158 in FIG. 6A). The slicing fixture 162 has a cavity 164. Inside the cavity 164 are grooved bars 166. The grooves 168 in the grooved bars 166 demarcate the positions where the mat (158 in FIG. 6A) will be cut. FIG. 6C shows the mat 158 mounted in the slicing fixture 162, on top of the grooved bars (166 in FIG. 6B). Top bars 170 may be mounted on the support fixture 162 to clamp the mat 158 to the groove bars (166 in FIG. 6B).

Figure 6D:
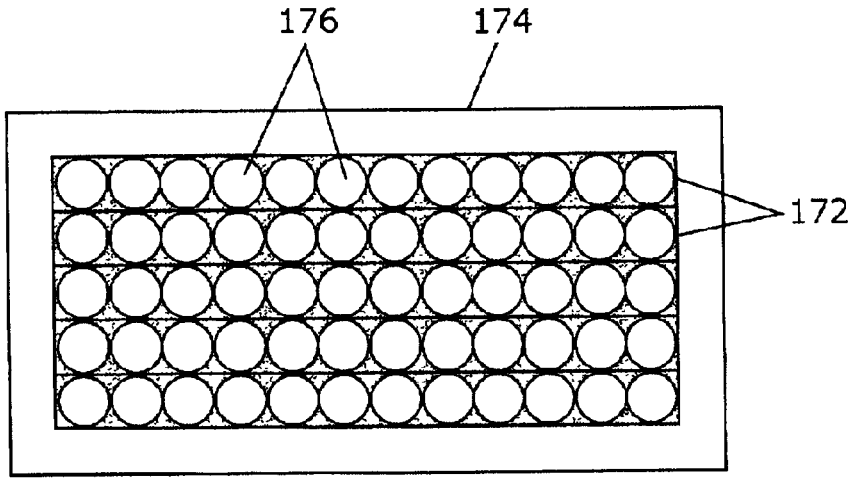
FIG. 6D shows strips of lenses arranged in a clamping band.

The mat 158 is cut into multiple slices or strips by passing a slicing blade (not shown) in between the top bars 170, through the mat 158, and into the grooves (168 in FIG. 6B) in the grooved bars (166 in FIG. 6B). The strips can be finished individually, as previously described. Alternatively, as shown in FIG. 6D, the strips 172 can be arranged in a clamping band 174. The clamping band 174 can then be tightened around the strips 172 to form a large single unit that can be finished in the same manner that a single lens would be finished. The finishing process steps have been previously discussed with reference to FIG. 1. The individual lenses 176 are extracted from the strips 172 by simply removing the mat strips holding them together.

The invention has been described for lenses having flat surfaces. For faceted lenses, i.e., lenses having angled faces, additional steps are required. After polishing and cleaning the slices as indicated at steps ST110 and ST112 in FIG. 1, the lenses in the slice are rotated through an angle that is typically in a range from 4 to 12 degrees. Typically, this process involves transferring the lenses in the slice into a lens facet fixture having an oriented surface. In this rotated position, the faces of the lenses that are to be angled are slanted with respect to the horizontal. The additional steps for forming the angled faces on the lenses includes lapping the slanted faces of the lenses until they are horizontal. Then the lenses are cleaned, the lapped faces are polished, and the lenses are cleaned again. When the lenses are returned to their normal position, the lapped and polished faces will be angled. The faceted lenses are further processed as indicated at steps ST114 through ST124 in FIG. 1.

Figure 7A:
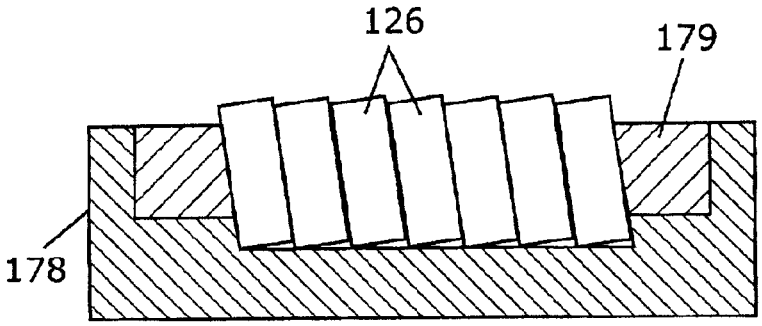
FIG. 7A shows a fixture for orienting lenses.
Figure 7B:
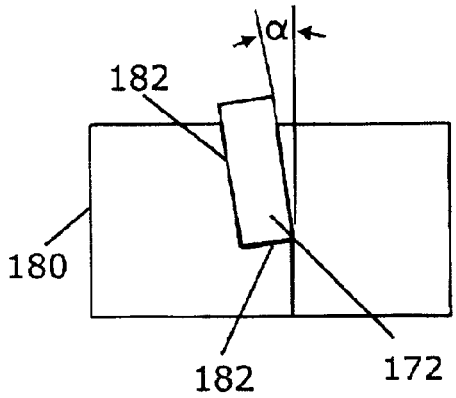
FIG. 7B shows a strip of lenses arranged in a lens facet fixture.
Figure 7C:
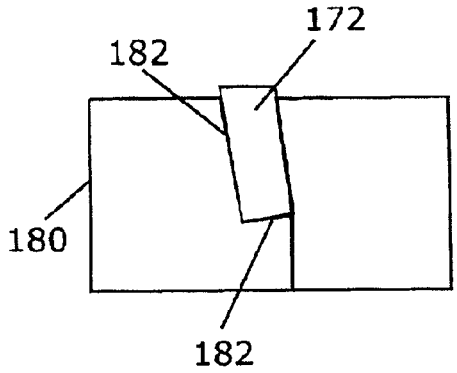
FIG. 7C shows the strip of lenses after lapping and polishing.

There are various methods for rotating the lenses in a slice through an angle. Typically, the method used will depend on the configuration of the slice. For example, for the slice 157 (shown in FIG. 5C) held by split ring 154 (shown in FIG. 5C), a fixture having an angled ring can be used. FIG. 7A shows a fixture 178 having an angled ring 179. The slice 157 (shown in FIG. 5C) could be placed above the angled ring 179, and the split ring 154 (shown in FIG. 5C) can be released so that the lenses in the slice 157 (shown in FIG. 5C) fall into the angled ring 179. The lenses 126 are rotated through an angle upon tightening the angled ring 179. The oriented lenses 126 can be processed as discussed above to form the facet angles. A strip of lenses, such as strip 172 in FIG. 6D, can be placed in a fixture that has angled surfaces, e.g., fixture 180 in FIG. 7B with angled surfaces 182. The lenses in the strip 172 are rotated when placed in between the angled surfaces 182. FIG. 7C shows the strip 172 after lapping and polishing.

The invention provides one or more advantages. In particular, multiple lenses can be finished simultaneously by grouping them together into a single unit. This substantially improves the output of the process and minimizes damage to the glass material.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of producing lenses, comprising:

assembling a plurality of glass rods having a desired length in side-by-side configuration into a single unit;

cutting the single unit into multiple slices, each slice comprising an array of glass rod pieces;

finishing the slices to a desired thickness and surface finish wherein finishing the slices comprises forming a facet angle on at least one of the slices; and extracting the glass rod nieces from the slices to produce a plurality of individual lenses.

2. The method of claim 1, wherein assembling a plurality of glass rods comprises inserting the glass rods into a housing and filling the housing with a blocking medium.

3. The method of claim 2, wherein extracting the glass rod pieces from the slices comprises removing the blocking medium from the slices.

4. The method of claim 1, wherein assembling a plurality of glass rods comprises inserting the glass rods into a plurality of split rings spaced in a row and tightening the split rings around the glass rods.

5. The method of claim 4, wherein extracting the glass rod pieces from the slices comprises loosening the split rings.

6. The method of claim 1, wherein assembling a plurality of glass rods comprises arranging the glass rods in a row between a mat.

7. The method of claim 6, wherein extracting the glass rod pieces from the slices comprises separating the mat from the glass rod pieces.

8. The method of claim 6, wherein the mat comprises plastic film.

9. The method of claim 6, wherein the mat comprises glass.

10. The method of claim 1, wherein finishing the slices comprises lapping the slices.

11. The method of claim 1, wherein finishing the slices comprises polishing the slices.

12. The method of claim 1, wherein finishing the slices comprises coating the slices with an anti-reflective material.

13. The method of claim 1, wherein forming a facet angle on at least one of the slices comprises placing the slice in a fixture that orients a face of each of the glass rod pieces in the slice at an angle.

14. The method of claim 13, further comprising lapping the oriented faces of the glass rod pieces.

15. The method of claim 13, further comprising polishing the oriented faces of the glass rod pieces.

16. The method of claim 1, wherein the glass rods have a gradient refractive index.

* * * * *